US005980316A

United States Patent [19]

Shinchi

[11] Patent Number: 5,980,316

[45] Date of Patent: Nov. 9, 1999

[54] WATERPROOF CONNECTOR

[75] Inventor: Akira Shinchi, Shizuoka, Japan

[73] Assignee: Yazaki Corporation, Tokyo, Japan

[21] Appl. No.: 09/055,952

[22] Filed: Apr. 7, 1998

[30] Foreign Application Priority Data

Apr. 9, 1997 [JP] Japan ..... 9-090754

[51] Int. Cl.[6] ..... H01R 13/40

[52] U.S. Cl. ..... 439/587

[58] Field of Search ..... 439/587, 589, 439/274, 275, 279, 523

[56] References Cited

U.S. PATENT DOCUMENTS 3,742,119 6/1973 Newman ..... 174/65 R

FOREIGN PATENT DOCUMENTS 50-54591 5/1975 Japan .
WO 91/07793 5/1991 WIPO .

*Primary Examiner*—Neil Abrams
*Assistant Examiner*—J. F. Duverne
*Attorney, Agent, or Firm*—Armstrong, Westerman, Hattori, McLeland & Naughton

[57] ABSTRACT

A waterproof connector having excellent waterproofing properties is provided. This waterproof connector consists of a connector main body 1 for receiving a plurality of terminals connected to wires 10 in parallel, and an elastomer packing 4 to be inserted into a concave portion 2 formed in the connector main body 1 at the wire connecting end. The elastomer packing 4 is made up of a pair of split modules 4A and 4B. Wire receiving grooves 5A and 5B for receiving the wires are formed on the contact surface of each split module 4A and 4B. With the wires 10 being placed into the wire receiving grooves 5A and 5B, the elastomer packing 4 is inserted into the concave portion 2. Elastomer packing pressing grooves 6A and 6B are formed on the outer periphery of the elastomer packing 4, and one elastomer packing pressing groove 6A and 6B is situated between every two neighboring wire receiving grooves 5A and 5B. Pressing ribs 3 to be engaged with the elastomer packing pressing grooves 6A and 6B are formed on the inner surface of the concave portion 2.

10 Claims, 3 Drawing Sheets

WATERPROOF CONNECTOR

BACKGROUND OF THE INVENTION

1. Field of the Invention

The present invention relates to a waterproof connector and, more particularly, to a waterproof connector which exhibits excellent waterproofing properties.

2. Related Art

Japanese Utility Model Application Laid-Open No. 50-54591 discloses a waterproof connector shown in FIG. 4.

Reference numeral 21 indicates a connector main body having a concave portion 21*a* formed at the wire extending end.

Reference numeral 23 indicates an elastomer packing which is made up of a pair of split modules 23*a* and 23*a'*. Grooves 23*b* for receiving the wires 22 are formed on the contact surfaces of the split modules 23*a* and 23*a'*. The wires 22 are placed in the grooves 23*b*, and the split modules 23*a* and 23*a'* are then pushed into the concave portion 21*a* of the connector main body 21.

With the conventional waterproof connector, however, there has been a problem as follows. When the elastomer packing 23 is engaged with the concave portion 21*a* of the connector main body 21, the contact surfaces of the split modules 23*a* and 23*a'* are pressed in a direction perpendicular to each of them, as shown in FIG. 5, thus providing excellent waterproofing properties. On the other hand, the contact surfaces of the wires 22 and the elastomer packing 23, indicated by arrow A in FIG. 5, are subjected to no pressing force. As a result, water enters through the portions A, and the waterproofing properties deteriorate.

SUMMARY OF THE INVENTION

The principal object of the present invention is to provide a waterproof connector having excellent waterproofing properties.

The waterproof connector of the present invention consists of a connector main body for receiving a plurality of terminals connected to wires in parallel, and an elastomer packing to be inserted into a concave portion formed in the connector main body at the wire connecting end. The elastomer packing is made up of a pair of split modules. Wire receiving grooves for receiving the wires are formed on the contact surfaces of the pair of split modules. With the wires being placed in the wire receiving grooves of the pair of split modules, the elastomer packing is inserted into the concave portion of the connector main body. A rubber pressing groove is formed on the outer periphery of each split module. Such rubber pressing groove is situated between every two neighboring wire receiving grooves. Pressing ribs to be engaged with the rubber pressing grooves are formed on the inner surface of the concave portion. With the pressing ribs putting pressure on the wires from every direction, excellent waterproofing properties can be obtained.

In one embodiment of the waterproof connector of the present invention, the width of each pressing rib is greater than the width of each rubber pressing groove. Thus, the pressing force put on the wires from the contact surfaces of the split modules can be increased.

In certain embodiments of the waterproof connector of the present invention, protrusions are formed on the contact surface of one of the split modules of the elastomer packing. The protrusions are aligned in a direction perpendicular to the wires, so as to prevent entrance of water through gaps between the contact surfaces.

In yet another embodiment of the waterproof connector of the present invention, the protrusions are formed on the right (or left) half of the contact surface of a split module. Two split modules are prepared and then brought into contact with each other, so that the protrusions can be arranged in a line perpendicular to the wires. Since the two split modules have the identical structure, the production costs can be reduced.

The above and other objects and features of the present invention will be more apparent from the following description taken in conjunction with the accompanying drawings.

BRIEF DESCRITION OF THE DRAWINGS

DETAILED DESCRIPTION OF THE PREFERRED EMBODIMENTS

Figure 1:
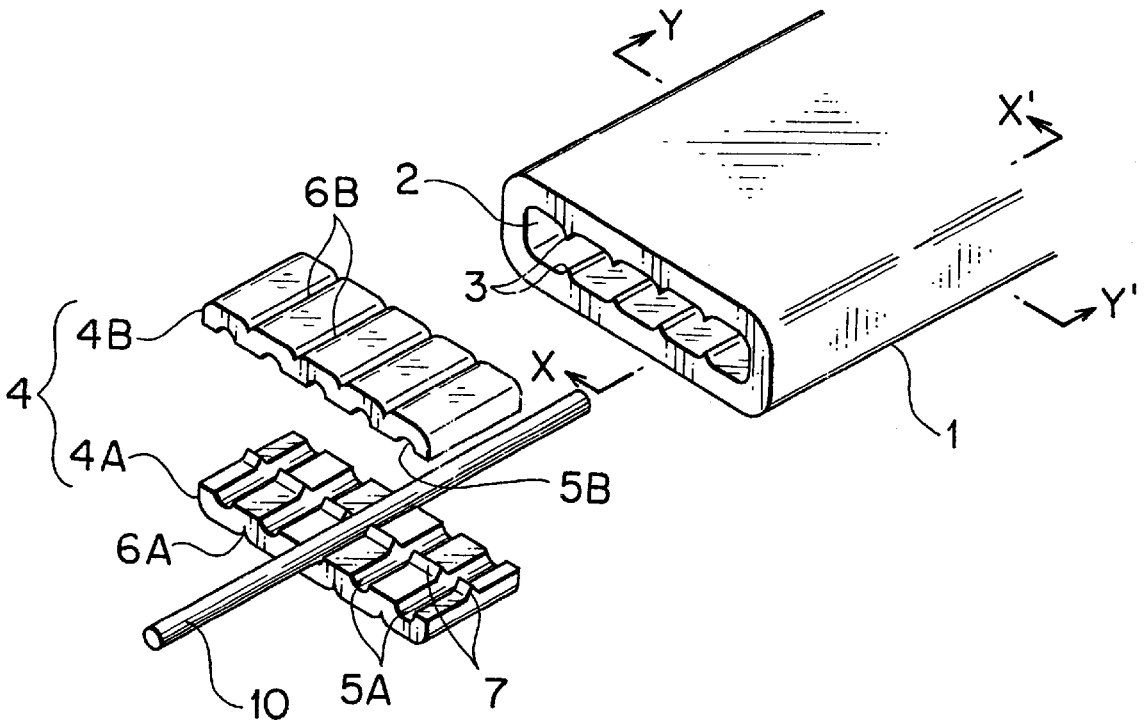
FIG. 1 is an exploded perspective view of one embodiment of the present invention.
Figure 2A:
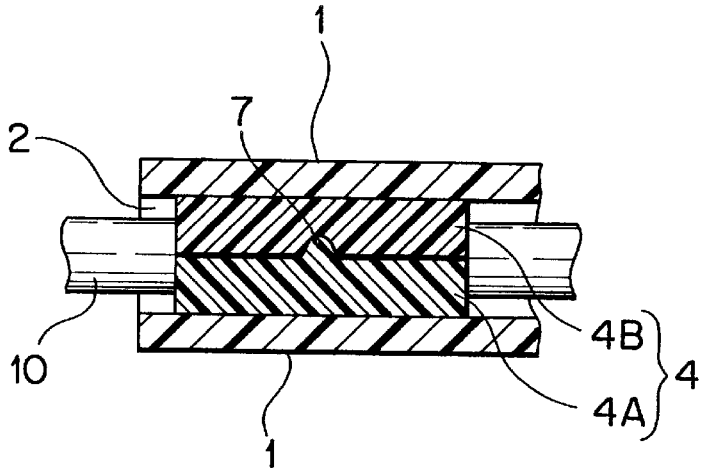
FIG. 2A is a sectional view taken along the line X–X' of FIG. 1.

The following is a description of one embodiment of the present invention, with reference to FIGS. 1 and 2.

In FIG. 1, reference numeral 1 indicates a connector main body made of a synthetic resin. A plurality of terminal receiving chambers are arranged in parallel in the front of the inside of the connector main body 1. Each terminal receiving chamber receives a terminal connected to a wire terminal (not shown). A concave portion 2 for receiving an elastomer packing 4 is formed in the rear of the connector main body 1 at its wire extending end.

The elastomer packing 4 is made up of a pair of spilt modules 4A and 4B.

Wire receiving grooves 5A and 5B each for receiving wires 10 are formed on the split modules 4A and 4B facing each other.

The structure mentioned so far is the same as in the prior art, but in the present invention, elastomer packing pressing grooves 6A and 6B are formed on the outer peripheries of the split modules 4A and 4B to be brought into contact with the inner surface of the connector portion 2. Such elastomer packing pressing grooves 6A and 6B are arranged in parallel with the wires 10. One elastomer packing pressing groove 6A is situated between every two neighboring wire receiving grooves 5A, while one elastomer packing pressing groove 6B is situated between every two neighboring wire receiving grooves 5B. Protrusions 7 are formed in a direction perpendicular to the wire 10 on one of the contact surfaces of the split modules 4A and 4B.

Meanwhile, pressing ribs 3 to be engaged with the elastomer packing pressing grooves 6A and 6B formed on the outer peripheries of the split modules 4A and 4B are provided on the inner surface of the concave portion 2 of the connector main body 1.

The split modules 4A and 4B are engaged with the concave portion 2 by putting the wires 10 in the wire receiving grooves 5A and 5B and pushing the split modules 4A and 4B such that the positions of the elastomer packing pressing grooves 6A and 6B formed on the outer peripheries of the split modules 4A and 4B will correspond to the pressing ribs 3 formed on the inner surface of the concave portion 2.

With the split modules 4A and 4B being engaged with the concave portion 2, the protrusions 7 formed on the split module 4A press the other split module 4B, so that the contact surfaces of the split modules 4A and 4B, as well as the contact surfaces of the split modules 4A and 4B and the concave portion 2, will be firmly brought into contact with each other so as to prevent entrance of water.

Figure 2B:
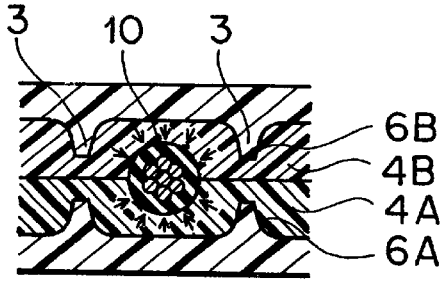
FIG. 2B is a sectional view taken along the line Y–Y' of FIG. 1.

As shown in FIG. 2B, the ribs 3 formed on the inner surface of the concave portion 2 press the split modules 4A and 4B as well as the rubber pressing grooves 6A and 6B. As a result of this, the wires 10 are pressed from every direction, so as to prevent water from entering through the gaps between the wires 10 and the wire receiving grooves 5A and 5B.

To press the wires from every direction using the pressing ribs 3, the width of each rib 3 should be greater than the width of each of the elastomer packing pressing grooves 6A and 6B formed on the outer peripheries of the split modules 4A and 4B.

Figure 3:
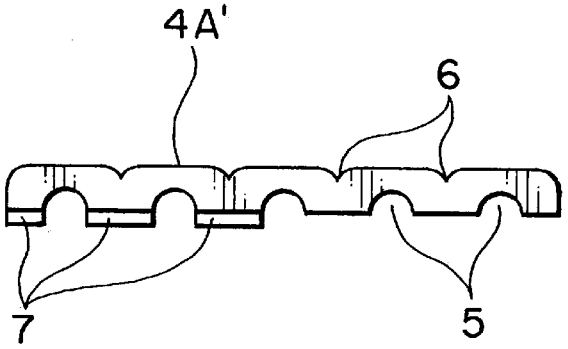
FIG. 3 is a sectional view of another embodiment of an elastomer packing in accordance with the present invention.
Figure 4:
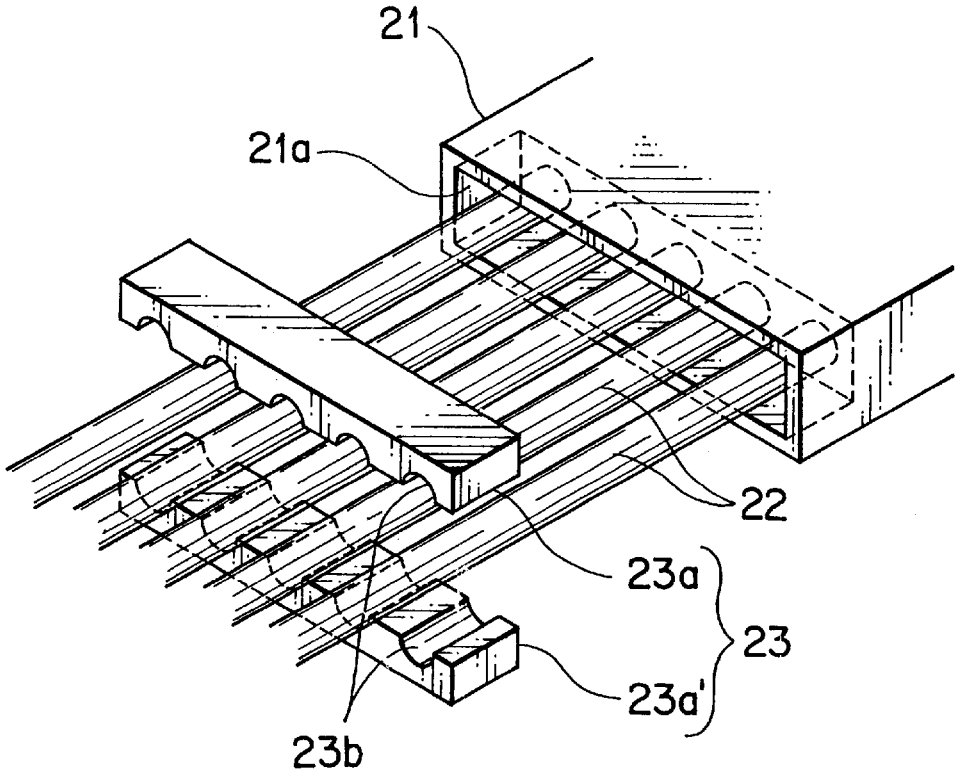
FIG. 4 PRIOR ART
FIG. 4 is a perspective view of the prior art.
Figure 5:
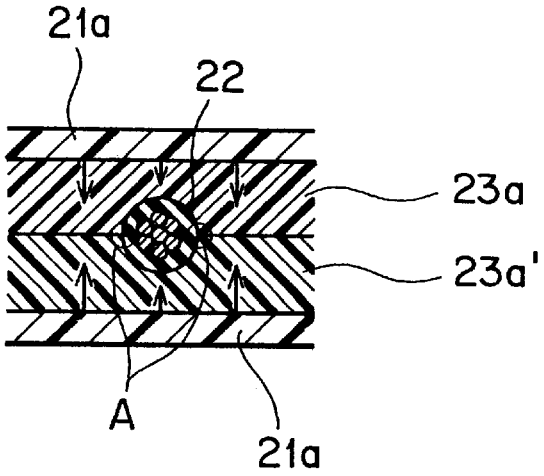
FIG. 5 PRIOR ART
FIG. 5 illustrates drawbacks of the prior art.

Although the protrusions 7 are formed on either the split module 4A or 4B in the above embodiment, they may be provided on the right (or left) half of the contact surface of a split module 4A' as shown in FIG. 3. Two such split modules 4A' should be prepared and then brought into contact with each other so that the protrusions 7 can be arranged in a line perpendicular to the wires 10.

With such structure, the elastomer packing 4 puts together the two split modules 4A' of the same structure that are laterally inverted. Since the split modules 4A' are the same, the number of components required can be reduced, and the production costs can be lowered.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A waterproof connector comprising:

a connector main body for receiving a plurality of terminals connected to wires in parallel;

a concave portion formed in the connector main body at the wire connecting end;

an elastomer packing made up of a pair of split modules to be inserted into the concave portion;

wire receiving grooves for receiving the wires formed on contact surfaces of the pair of split modules;

elastomer packing pressing grooves formed on an outer periphery of the elastomer packing in parallel with the wires, any of the elastomer packing pressing grooves being situated between two neighboring wire receiving grooves formed on the pair of split modules; and pressing ribs to be engaged with the elastomer packing pressing grooves, the pressing ribs being formed in parallel with the wire receiving grooves, situated between two neighboring wire receiving grooves, and on an inner surface of the concave portion.

2. The waterproof connector according to claim 1, wherein a width of each pressing rib is greater than a width of each elastomer packing pressing groove.

3. The waterproof connector according to claim 1, further comprising protrusions formed on the contact surface of one of the split modules of the elastomer packing, and aligned in a direction perpendicular to the wires.

4. The waterproof connector according to claim 1, wherein the protrusions are provided on a half of the contact surface of a split module and on a half of the contact surface of the other split module, and the contact surfaces of the two split modules are laterally inverted and then brought into contact with each other so that the protrusions can be arranged in a line perpendicular to the wires.

5. The waterproof connector according to claim 3 or 4, wherein the protrusions are situated roughly in a center of the pair of split modules.

6. The waterproof connector according to claim 2, further comprising protrusions formed on the contact surface of one of the split modules of the elastomer packing, and aligned in a direction perpendicular to the wires.

7. The waterproof connector according to claim 2, wherein the protrusions are provided on a half of the contact surface of a split module and on a half of the contact surface of a split module and the contact surfaces of the two split modules are laterally inverted and then brought into contact with each other so that the protrusions can be arranged in a line perpendicular to the wires.

8. The waterproof connector according to claim 4, wherein the protrusions are situated roughly in the center of the pair split modules.

9. The waterproof connector according to claim 6, wherein the protrusions are situated roughly in the center of the pair split modules.

10. The waterproof connector according to claim 7, wherein the protrusions are situated roughly in the center of the pair split modules.

* * * * *